US006829530B2

(12) United States Patent
Mauro et al.

(10) Patent No.: US 6,829,530 B2
(45) Date of Patent: Dec. 7, 2004

(54) METHOD OF DIAGNOSING A VEHICLE ENGINE COOLING SYSTEM

(75) Inventors: Marco Mauro, San Remo (IT); Maria Paola Bianconi, Turin (IT); Mario Gambera, Orbassano (IT); Andrea Fortunato, Orbassano (IT)

(73) Assignee: C.R.F. Societa Consortile per Azioni, Orbassano (IT)

( * ) Notice: Subject to any disclaimer, the term of this patent is extended or adjusted under 35 U.S.C. 154(b) by 0 days.

(21) Appl. No.: 10/624,920

(22) Filed: Jul. 22, 2003

(65) Prior Publication Data

US 2004/0129067 A1 Jul. 8, 2004

(30) Foreign Application Priority Data

Jul. 23, 2002 (IT) ..... TO2002A0650

(51) Int. Cl.[7] ..... F01P 11/14
(52) U.S. Cl. ..... 701/114; 73/118.1
(58) Field of Search ..... 701/114, 102; 73/117.3, 118.1; 123/41.01, 41.15, 41.21, 41.27

(56) References Cited

U.S. PATENT DOCUMENTS

| | | | | |
|---|---|---|---|---|
| 4,662,316 A | * | 5/1987 | Kubozuka | 123/41.15 |
| 5,020,007 A | | 5/1991 | Wu et al. | 364/551.01 |
| 6,377,876 B1 | | 4/2002 | Hedeen et al. | 701/19 |

FOREIGN PATENT DOCUMENTS

| | | | | |
|---|---|---|---|---|
| EP | 1 384 869 A2 | * | 1/2004 | F01P/11/14 |
| FR | 2 673 244 | | 8/1992 | |
| FR | 2 837 525 | | 9/2003 | |
| JP | 2002-242720 | * | 8/2002 | F01P/11/16 |

* cited by examiner

*Primary Examiner*—Hieu T. Vo
(74) *Attorney, Agent, or Firm*—SEED IP Law Group PLLC

(57) ABSTRACT

A method of diagnosing a cooling system of a vehicle engine, including the steps of: acquiring operating data relative to operation of the cooling system (cooling system radiator water temperature/fan rotation speed) during a trip time between turn-on of the engine and subsequent turn-off of the engine; processing the acquired data, and accumulating the data for each trip to create a database; and examining the location of the data within the database to determine malfunction and/or potential malfunction situations of the cooling system.

13 Claims, 4 Drawing Sheets

METHOD OF DIAGNOSING A VEHICLE ENGINE COOLING SYSTEM

BACKGROUND OF THE INVENTION

1. Field of the Invention

The present invention relates to a method of diagnosing a vehicle engine cooling system.

2. Description of the Related Art

Vehicle engine cooling systems are known in which a stream of fluid (normally water) is fed to the inlet of a radiator connected to one or more cooling fans, which direct a stream of air through the radiator to produce an outward heat exchange, so that the water at the outlet of the radiator is cooler than at the inlet. As is known, due to aging and wear of the radiator and/or members producing forced flow of the water, the efficiency of the engine cooling system decreases considerably, and therefore also the difference between the temperature of the water at the inlet and outlet.

A need therefore exists for a method of fully automatically determining such a situation, and of also determining gradual decline of the engine cooling system to predict pending malfunction of the system well in advance.

BRIEF SUMMARY OF THE INVENTION

According to the present invention, there is provided a method of diagnosing a cooling system of a vehicle engine, characterized by comprising the steps of: acquiring operating data relative to operation of the cooling system between turn-on of the engine and subsequent turn-off of the engine; processing the acquired operating data and accumulating the data to create at least one database; and examining the location of the data within said database to determine malfunction and/or potential malfunction situations of said cooling system.

BRIEF DESCRIPTION OF THE DRAWINGS

A preferred, non-limiting embodiment of the invention will be described by way of example with reference to the accompanying drawings, in which.

DETAILED DESCRIPTION OF THE INVENTION

Figure 1:
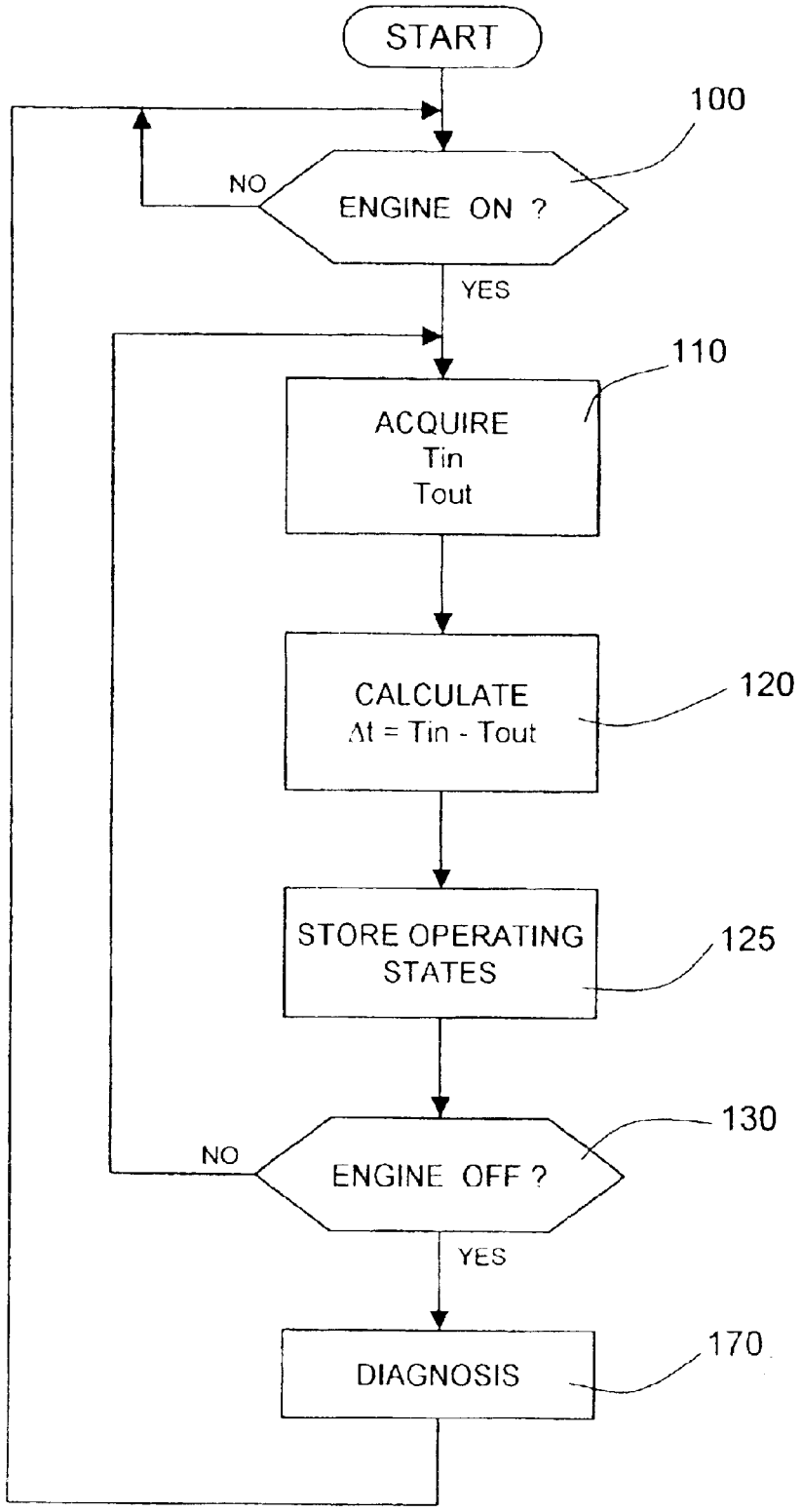
FIG. 1 shows the operations performed in the method according to the present invention.

FIG. 1 shows the operations performed in a first embodiment of the method, according to the present invention, of diagnosing the cooling system of a vehicle engine, in particular of an industrial vehicle.

To begin with, a block 100 determines whether the engine relative to the cooling system is on; if it is not (engine off), block 100 remains on standby; otherwise (engine on), block 100 goes on to a block 110.

Block 110 acquires and stores the temperature Tin of the water supplied to the cooling system radiator inlet, and the temperature Tout of the water at the cooling system radiator outlet.

Block 110 is followed by a block 120, which calculates and stores the temperature difference ΔT between the water temperature Tin at the radiator inlet and the water temperature Tout at the radiator outlet, i.e.:

$$\Delta T = Tin - Tout$$

Block 120 is followed by a block 125, which forms a data structure defining and storing operating states S(ΔT, Tin) of the radiator as a function of the calculated ΔT value and the inlet water temperature Tin.

The data structure also stores the time lapse Ts the cooling system remains in each operating state S(ΔT, Tin).

Figure 2:
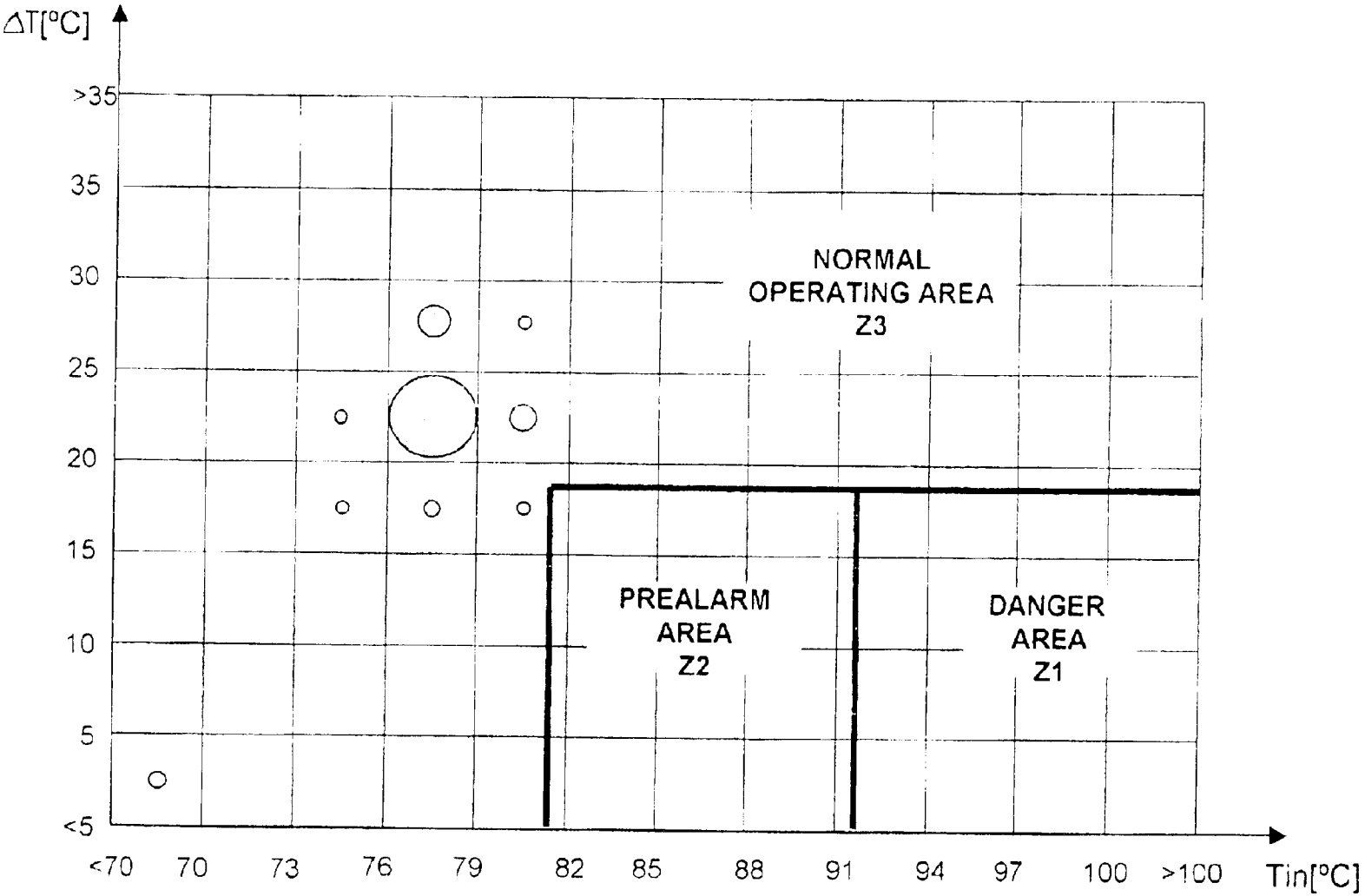
FIG. 2 shows a first database employed in the method according to the present invention.

For example, the database can be represented in a Cartesian X, Y plane by a spot graph—FIG. 2—in which each spot corresponds to a state, and the diameter of the spot shows how long the operating state is detected, i.e., the time lapse the cooling system remains in that particular operating state.

Block 125 is followed by a block 130, which determines whether the vehicle engine is off; if it is not (engine on and running), block 130 goes back to block 110; otherwise (engine off and not running), block 130 is followed by a diagnosis block 170.

At the output of block 130, the total trip time Ttrip (measured in seconds, minutes, or hours) between turning the engine on and off is also calculated, and equals the sum of the lapse times within the various detected operating states.

Blocks 100–130 thus determine the water temperature at the radiator inlet and outlet at successive instants, and calculate, for each finding, the temperature difference ΔT introduced by the radiator. Preferably, though not necessarily, blocks 100–130 are scanned so that temperatures Tin, Tout are determined and temperature difference ΔT calculated at predetermined time intervals, e.g., of one second.

It is known, in fact, that, when operating poorly or not at all, the radiator produces only a small reduction in the temperature of the fluid supplied to the inlet, i.e., temperature difference ΔT is close to zero or at least lower than normal operating values.

The operating states are thus stored and accumulated in different operating condition areas (shown by the grid in FIG. 2).

Alternatively, the operating states may be stored in the data structure as a function of the calculated ΔT value and the outlet water temperature Tout.

Alternatively or in addition, as opposed to the time lapse in each operating state, the time lapse in each state as a percentage of total trip time Ttrip may be stored.

At the end of each vehicle trip, i.e., when the engine is turned off, the three-dimensional data structure therefore contains the time lapses in the various detected operating states.

Repeated vehicle trips result in the generation of a database containing all the states in which the radiator has operated.

According to the present invention, block 170 periodically checks the database containing all the accumulated data structures to determine any malfunction situations.

For which purpose, the X, Y plane map (FIG. 2) shows a number of calibratable areas, including:

a danger area Z1;

a prealarm area Z2; and a normal or safe operating area Z3.

Areas Z1, Z2 and Z3 in the X,Y plane can be calibrated as a function of the type of trip and the characteristics of the vehicle.

The check by block 170 can be made in three ways:

by checking the data structure at the end of each trip of each vehicle to determine instantaneous malfunctions (e.g., at least one operating state in danger area Z1);

by checking the data structures of a number of trips of each vehicle to determine decline situations (e.g., migration of accumulated operating states from normal operating area Z3 to areas Z1 and Z2; and comparing the data structures of different vehicles to determine anomalies of one vehicle with respect to the rest of the fleet (e.g., a mean concentration of fleet radiator operating conditions in a normal operating sub-area, and individual vehicle operating conditions concentrated in a different normal operating sub-area).

Malfunctioning of the radiator may be determined on the basis of a number of criteria, including:

an operating state within danger area Z1 over and above a given maximum time lapse, i.e., malfunctioning is determined when the temperature difference produced by the radiator remains small for a long total period of time and for numerous vehicle trips;

migration of the time lapse values in various operating states towards danger area Z1, i.e., the temperature difference decreases with time as the radiator gradually declines:

an operating state distribution differing from that of the other vehicles in the fleet.

Figure 3:
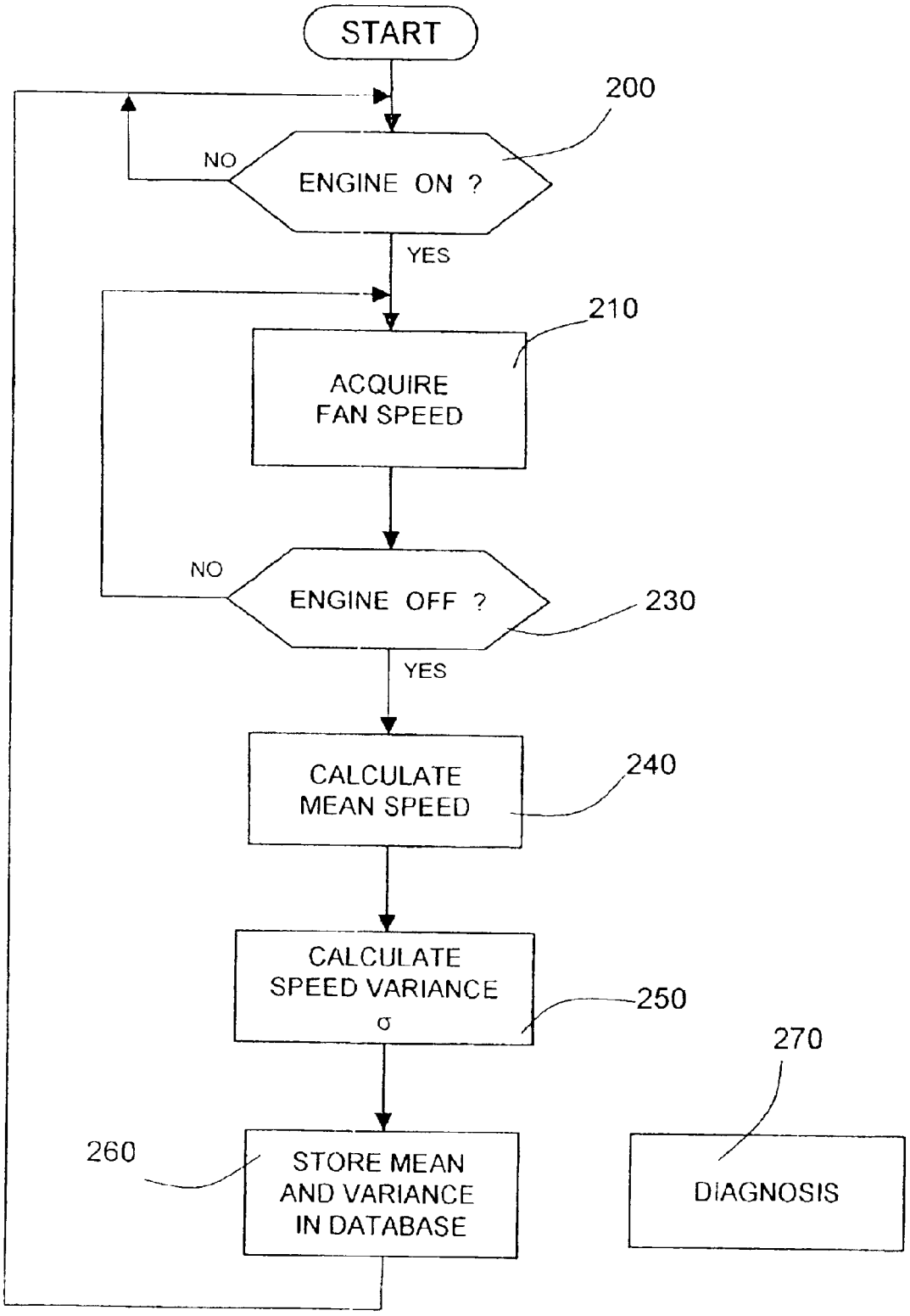
FIG. 3 shows a variation of the method according to the present invention.

In the FIG. 3 method, a first block 200 determines whether the engine relative to the cooling system is on; if it is not (engine off), block 200 remains on standby; otherwise (engine on), block 200 goes on to a block 210.

Block 210 acquires and stores the rotation speed ωv of the cooling system radiator fan.

Block 210 is followed by a block 230, which determines whether the vehicle engine is off; if it is not (engine on and running), block 230 goes back to block 210; otherwise (engine off and not running), block 230 is followed by a block 240.

At the output of block 230, the total trip time Ttrip (measured in seconds, minutes, or hours) between turning the engine on and off is also calculated.

Blocks 200–230 thus determine fan rotation speed at successive instants, to obtain n speed samples. Preferably, though not necessarily, blocks 200–230 are scanned so that fan rotation speed is determined at predetermined time intervals, e.g., of one second, during trip time Ttrip.

Block 240 calculates the mean fan rotation speed value ωv_med, i.e.

$$\frac{\omega v_med = \sum_{i=1}^{i=n} \omega vi}{n}$$

where n is the number of speed samples acquired repetitively by blocks 200–230 within the trip time.

Block 240 is followed by a block 250, which calculates the fan rotation speed variance σ:

$$\sigma^2 = \frac{\left[\sum (\omega_{vi} - \omega_{v_med})^2\right]}{n}$$

where n is the number of speed samples acquired repetitively by blocks 200–230 within the trip time.

Block 250 is followed by a block 260, which stores the calculated mean speed and variance values in respective databases.

At the end of each vehicle trip, i.e., when the engine is turned off, the database is therefore updated to accumulate the calculated mean speed and variance values of the concluded trip.

Repeated vehicle trips result in the generation of a database containing a mean speed value for each trip, and a database containing a variance value for each trip.

Figure 4:
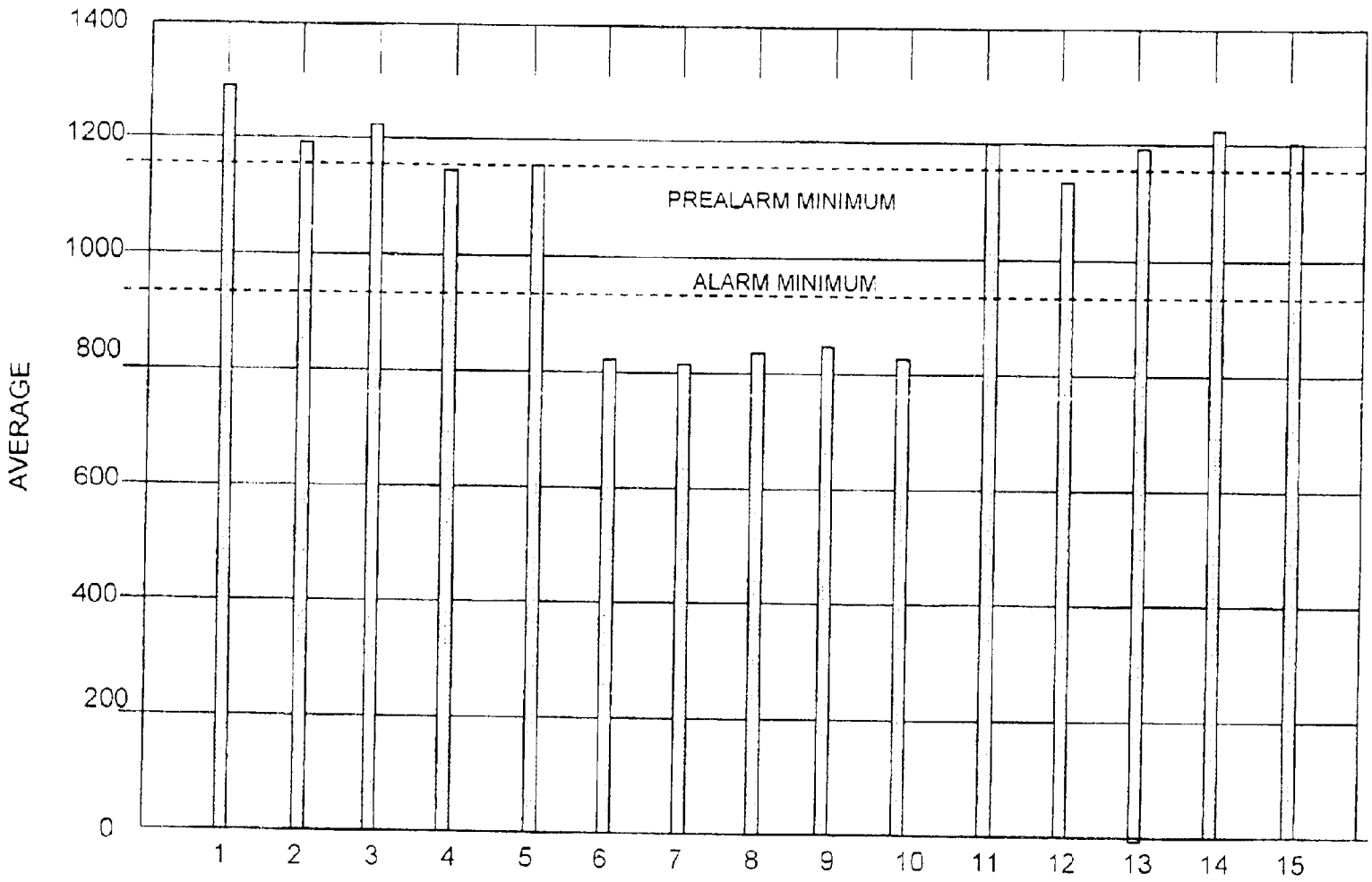
FIG. 4 shows a second database employed in the method according to the present invention.

FIG. 4 shows an example of a database showing mean speed values accumulated over successive trips.

According to the present invention, a process, independent of the operations in blocks 200–260 and indicated by block 270 in FIG. 3, periodically checks one or both databases to determine any malfunction situations.

Malfunctioning of the radiator may be determined on the basis of a number of criteria, including:

mean speed and/or variance values exceeding prealarm and alarm (minimum or maximum) values;

a check of the development over time of the mean speed and/or variance values to determine migration towards prealarm and alarm values.

The prealarm and alarm values can be calibrated.

The method according to the present invention therefore provides for fully automatically determining a malfunction situation of the engine cooling system.

Moreover, the method also determines gradual deterioration of the engine cooling system to predict malfunctioning of the system.

What is claimed is:

1. A method of diagnosing a cooling system of a vehicle engine, characterized by comprising the steps of:

acquiring operating data relative to operation of the cooling system between turn-on of the engine and subsequent turn-off of the engine;

processing the acquired operating data and accumulating the data to create at least one database; and examining the location of the data within said database to determine malfunction and/or potential malfunction situations of said cooling system.

2. A method as claimed in claim 1, wherein said step of acquiring operating data relative to operation of the cooling system comprises the step of acquiring fluid temperatures of a radiator of said cooling system.

3. A method as claimed in claim 2, wherein said acquiring step comprises the step of acquiring the temperature of the fluid supplied to the inlet and outlet of said radiator.

4. A method as claimed in claim 3, and comprising the step of calculating the temperature difference between the fluid supplied to the inlet and outlet of said radiator.

5. A method as claimed in claim 4, wherein said accumulating step comprises the step of forming a data structure in which are stored a number of operating states, each defined as a function of the calculated temperature difference value and the acquired outlet fluid temperature value.

6. A method as claimed in claim 4, wherein said accumulating step comprises the step of forming a data structure in which are stored a number of operating states, each defined as a function of the calculated temperature difference value and the acquired inlet fluid temperature value.

7. A method as claimed in claim 1, wherein said step of acquiring operating data relative to operation of the cooling system comprises the step of acquiring the rotation speed of a fan associated with a radiator of said cooling system.

8. A method as claimed in claim 7, wherein said step of processing the acquired operating data comprises the steps of:

calculating the mean value of said rotation speed; and calculating the variance of said rotation speed.

9. A method as claimed in claim 8, wherein said accumulating step comprises the step of forming a data structure storing the mean value of the rotation speed values acquired between turn-on and subsequent turn-off of said engine.

10. A method as claimed in claim 8, wherein said accumulating step comprises the step of forming a data structure storing the variance of the rotation speed values acquired between turn-on and subsequent turn-off of said engine.

11. A method as claimed in claim 1, wherein said step of examining the location of the data within said database comprises the steps of:

defining different areas within said database, corresponding to different operating states of said cooling system; and checking the location of said data within said areas.

12. A method as claimed in claim 11, wherein said step of examining the location of the data within said database comprises the step of determining when a maximum time value associated with an acquired operating state located in a danger area is exceeded.

13. A method as claimed in claim 11, wherein said step of examining the location of the data within said database comprises the step of determining migration of said operating states towards a danger area.

* * * * *